United States Patent [19]

Kolinsky

[11] Patent Number: 4,909,516

[45] Date of Patent: Mar. 20, 1990

[54] AUTOMATED CARD GAME SYSTEM

[75] Inventor: Alfred P. Kolinsky, Baltimore, Md.

[73] Assignee: Bingotech, Inc., Baltimore, Md.

[21] Appl. No.: 626,419

[22] Filed: Jun. 29, 1984

[51] Int. Cl.[4] ..... A63F 3/06

[52] U.S. Cl. ..... 273/237; 273/269; 273/85 G

[58] Field of Search ..... 273/237, 269, 144 R, 273/85 G

[56] References Cited

U.S. PATENT DOCUMENTS

| | | | |
|---|---|---|---|
| 4,177,462 | 12/1979 | Chung | 273/85 G |
| 4,455,025 | 6/1984 | Itkis | 273/269 |
| 4,475,157 | 10/1984 | Bolan | 273/269 |
| 4,624,462 | 11/1986 | Itkis | 273/237 |

OTHER PUBLICATIONS

"Bingo", *101 BASIC Computer Games*, DEC, Maynard, Mass., pp. 36–38.

*Primary Examiner*—Leo P. Picard

*Attorney, Agent, or Firm*—Cushman, Darby & Cushman

[57] ABSTRACT

An automated card game system includes cards for distribution to players, a random card number generator, a memory for storing the cards, a keyboard for inputing the randomly selected card numbers into the memory, and a display system for displaying the random card numbers selected. The cards stored in the memory are continuously updated by being marked in accordance with the randomly generated card numbers and the status of the cards is continuously monitored in order to automatically determine a winning card.

20 Claims, 10 Drawing Sheets

FIG. 6

| B<br>1-15 | I<br>16-30 | N<br>31-45 | G<br>46-60 | SN:AJ527<br>O<br>61-75 |
|---|---|---|---|---|
| 8 | 17 | 31 | 60 | 67 |
| 10 | 20 | 36 | 51 | 64 |
| 11 | 16 | FREE SPACE<br>FN:XZ715 | 47 | 70 |
| 2 | 27 | 42 | 55 | 68 |
| 5 | 19 | 44 | 48 | 75 |

AUTOMATED CARD GAME SYSTEM

FIELD OF THE INVENTION

The invention is related to an automated card game system such as, for example, a bingo game.

BACKGROUND OF THE INVENTION

In playing bingo, players are provided with cards having 24 numbers arranged in a 5×5 matrix with a center "free" square. The numbers 1–75 are grouped with the letters such that numbers 1–15 are associated with the letter B, numbers 16–30 are associated with the letter I, numbers 31–45 are associated with the letter N, numbers 46–60 are associated with the letter G and numbers 61–75 are associated with the letter 0. As numbers from 1–75 are randomly selected, individual players mark the selected numbers on their card. United States Pat. Nos. 3,653,026 to Hurley and 4,121,830 to Buckley are directed to improved systems for randomly selecting bingo card numbers. United States Pat. No. 4,312,511 to Julien is directed to an electronic bingo game in which the various numbers drawn in the game are displayed.

In the most elementary form of the game, the first player to complete a horizontal row, a vertical column or the four corners of the bingo card is the winner. Additionally, other levels or types of bingo games include the first player to have marked the entire external perimeter or "window frame" of the bingo card, and the first player to have covered or marked every number on the bingo card.

Bingo and other similar card games have proven to be popular games for all age groups, but have heretofore been restricted to the playing in an auditorium or hall thereby limiting the number of participants to the capacity of the hall. Furthermore, the fact that players must accurately mark their own cards in order to be declared a winner has disadvantages for certain groups of players. For example, the physically impaired, the very young with under-developed reflexes and muscle control or the elderly with slowed reflexes and/or failing eyesight are at a distinct disadvantage when competing with players who do not suffer from these infirmities. Additionally, any player who misses the calling or announcement of a particular number and thus fails to mark that number on the game card may lose that particular game even though the card is a "winning card" by virtue of having printed thereon all the numbers called during that particular game.

United States Pat. Nos. 3,786,234 to Trent et al and 4,033,588 to Watts disclose automated Keno games. Trent et al discloses a system in which the identity of marked numbers is used at the local ticket selling station so as to print duplicate Keno cards. Watts suggests in an alternative embodiment at column 22, lines 27–63 a computerized system that simultaneously plays the Keno game with human participants. But Watts does not provide an enabling disclosure for such a system, nor does it disclose a computerized system in which the level of the game is progressively changed and winners are announced at each level of the game.

SUMMARY OF THE INVENTION

It is an object of the present invention to provide an automated bingo or like game.

It is a further object of the present invention to make the playing of bingo or a like game available to a mass audience which is disbursed geographically.

It is a further object of the present invention to better insure that the holder of a "winning card" will actually collect the prize or win the game.

In order to accomplish the above stated objectives the present invention comprises, game cards which are preprinted with unique format numbers, serial numbers and game data contents, and a computer system which includes a memory loaded with enough information to identify all of the numbers on each sequentially format numbered card, i.e., a memory which also stores the game data on each card. As random numbers or play data from the available universe of possible numbers are selected by the computer and annunciated to various human participants who mark their own serially numbered cards accordingly, the computer also updates its memory files in a similar fashion to, in effect, play all of the cards at once within its own internal memory.

In addition to actually playing the cards, the computer simultaneously checks for any winning cards among the sequentially format numbered and distributed cards. As soon as a winner is selected, the identity of the winning format number is annunciated to the humans and the game is either ended or progressively changed. For example, the first play of the game could be looking for any five consecutive numbers in a straight row or diagonally across any given card. As soon as a winner is detected for that mode of the game, the game could be changed so as to look for an entire "window" frame of numbers about the entire periphery of any given card. Once a winner for that mode of game participation has been detected and annunciated, the game could be further and progressively changed so as to look for an entirely filled card.

More specifically, the invention comprises, for example, for the game of bingo a standard bingo ball popper for randomly and sequentially generating bingo card numbers, a computer or like device being capable of "playing" bingo cards which have been stored in its memory and a keyboard for entering the randomly determined bingo card numbers into the computer. The computer has sufficient memory for storing representations or game data of at least 6,000 bingo cards and is able to "play" all the cards in its memory simultaneously. In addition, the computer outputs an RGB color signal suitable for interfacing with an NTSC signal converter for broadcasting the bingo card numbers drawn to a mass audience which is dispersed geographically. The broadcasted signal can be provided to cable television or broadcast television. A second output of the computer or memory means can be used to drive a video monitor for displaying the drawn bingo card numbers to a local audience, for monitoring purposes or for providing instructions to the game operator.

Thus, the automated card system games of the present invention involve the simultaneous play by a multitude of human participants and by a computer, of games involving sequentially numbered physical cards distributed to the human participants with the computer automatically identifying the winning participants and stopping or changing the nature of the game at that time. That is, a multitude of humans play a particular game using sequentially numbered cards or the like while the computer simultaneously plays the same game for each of the human participants and detects all winners, annunciating that fact and perhaps changing the nature of the game when one or more winners are detected before the game is played any further.

FIGS. *3a–3d* are a flow chart describing the operation of the overall system.

FIG. 4 is an explanatory flow chart showing the generation of bingo cards.

Figure 1:
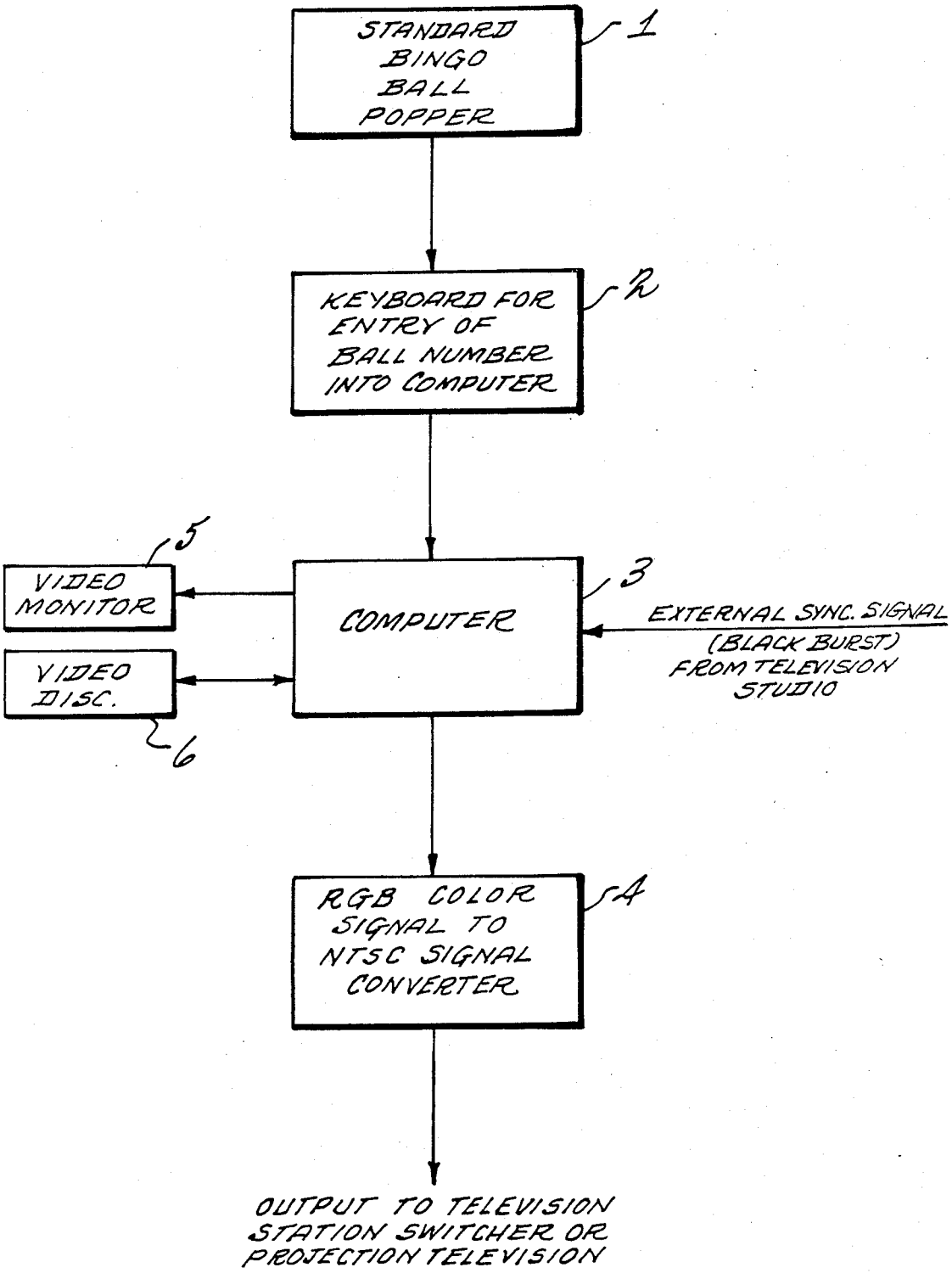
FIG. 1 is a block diagram of an automated bingo game system.

FIG. *5a* and *5b* are explanatory diagrams illustrating the "sets" analysis method which the system of FIG. 1 uses in order to determine bingo game winners.

FIG. 6 shows one example of a bingo card which can be generated by the computer of the present invention.

DETAILED DESCRIPTION OF THE INVENTION

FIG. 1 shows an automated bingo game system according to the present invention to be comprised of a standard bingo ball popper 1 using numbered ping-pong balls, a data processing means or computer 3, a keyboard 2 for entry of the drawn ball numbers into the computer, an RGB color signal to NTSC signal converter 4, a video monitor 5 and a video disc drive 6. The standard bingo ball popper 1 is a conventional type having, for example, 75 ping-pong balls sequentially numbered which are continuously mixed or driven together randomly by blasts of air until a single numbered ball finds its way to an exit chute. At this time, the bingo game operator withdraws the ball from the exit chute and inputs its number into the computer via the keyboard 2. As mentioned above, the computer 3 has sufficient memory capacity in conjunction with the video disc drive system 6 to "play" up to 6,000 bingo playing cards which have already been stored in the computer's memory or the memory in the associated video disc drive 6. The method by which the computer is able to "play" the bingo cards will be described in greater detail below.

The computer can be, for example, an IBM/PC in which a ROM is provided, for storing a program by which the computer 3 is able to generate color signals which display the bingo card numbers drawn and inputed through the keyboard 2. The system is also capable of displaying representations of the winning bingo cards, including the identifying format numbers of the cards, as well as the total prizes won. A genlock color graphics card Serial No. GL512 manufactured by On-Line Computer Systems, Inc. can be used to allow color graphics to be overlaid over text and also to allow the computer output signals to be synchronized with external broadcast or closed circuit transmission equipment.

In order that the aforementioned information can be broadcast for display on television sets the computer outputs an RGB color signal to NTSC signal converter 4 and in addition receives an external synchronizing signal from the television studio, which is to broadcast the aforementioned information. Also shown in FIG. 1 is a video monitor 5 which is driven by the computer 3 and which can be suitably located at the television studio or at a local auditorium where the game is to be played, in order that the local participants can play the game and/or that the game's progress can be monitored for maintenance purposes or so that the game operator can receive game instructions.

Figure 2:
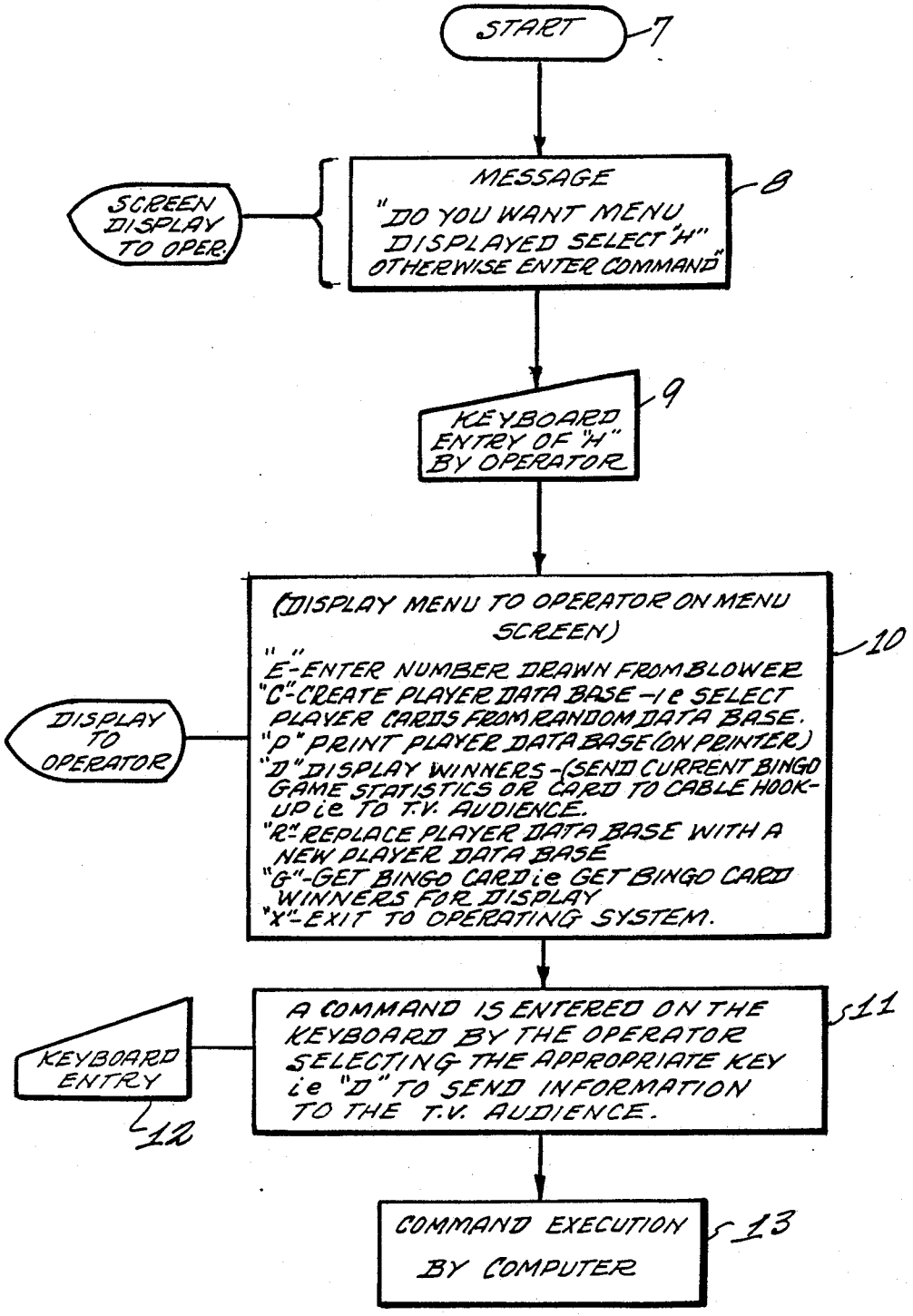
FIG. 2 is a flow chart describing the keyboard and display interaction of the system of FIG. 1.

FIG. 2 shows a flow chart describing how an operator of the system can display the system menu in order to enter commands to obtain particular system functions. For example, after the system has undergone start-up in a start block 7, the system displays a message to the operator, as shown in block 8, which asks whether the system menu should be displayed or whether a command is to be entered. As stated in the message, if the operator wants to display the system menu the operator must select key "H" on the keyboard 2 shown in FIG. 1. Block 9 of FIG. 2 shows the entry of the key "H" by the operator on the keyboard 2 and block 10 shows the display which results. As can be seen in block 10, a number of functions are listed including function E which allows an operator to enter the number of a ball drawn from the bingo ball popper, function C which allows an operator to create a player data base, for example by selecting at random bingo cards which have already been stored in the data base or memory of the computer, function P which allows the operator to print the player data base on an auxiliary printer (not shown), function D in which the winners, game statistics, etc., can be displayed, function R which allows the operator to replace a player data base with a new player data base, function G which allows an operator to pull up for display those bingo cards which are winners and function X which allows the operator to exit to the operating system. Thus, a keyboard entry, as shown in block 12, corresponding to the desired function is provided to a command block 11 so that the command can be executed by the computer, as shown in block 13.

FIGS. *3a*, *3b*, *3c* and *3d* show a flow chart which describes how the computer 3 of the system is programmed to operate. After a start step 101 the program initializes a player data base containing the bingo cards which the computer is to "play". In the step 102 the program creates sets for its win analysis of the bingo cards, a detailed description of how the sets win analysis operates will be described below. After the initialization step 102 the program proceeds to a step 103 where the operator is instructed to obtain a numbered ball from the bingo ball popper. After the operator obtains the bingo ball from the bingo ball popper in step 104 the operator inputs the number drawn, as represented by the drawn numbered ball, in a step 105. At step 106 the computer displays the number which has been drawn and input by the operator, and at this time the program proceeds to a step 107 where a first bingo card is checked to determine if it has the number which has been drawn. The step 108 is the actual decision step where the program determine whether the particular card being checked contains the number which has been drawn. If the decision in step 108 is NO the program returns to check the next bingo card in step 109. From step 109 the program proceeds to step 110 to determine whether all the cards in the data base have been checked. If the decision in step 110 is NO, i.e., not all the cards have yet been checked to determine if they contain the number which has been drawn, the program returns to step 107 to check the next bingo card. If the decision in step 110 is YES, i.e., all the cards have been checked, then the computer program is returned to step 103 in order to instruct the operator to obtain the next drawn number from the bingo ball popper or blower.

Figure 3A:
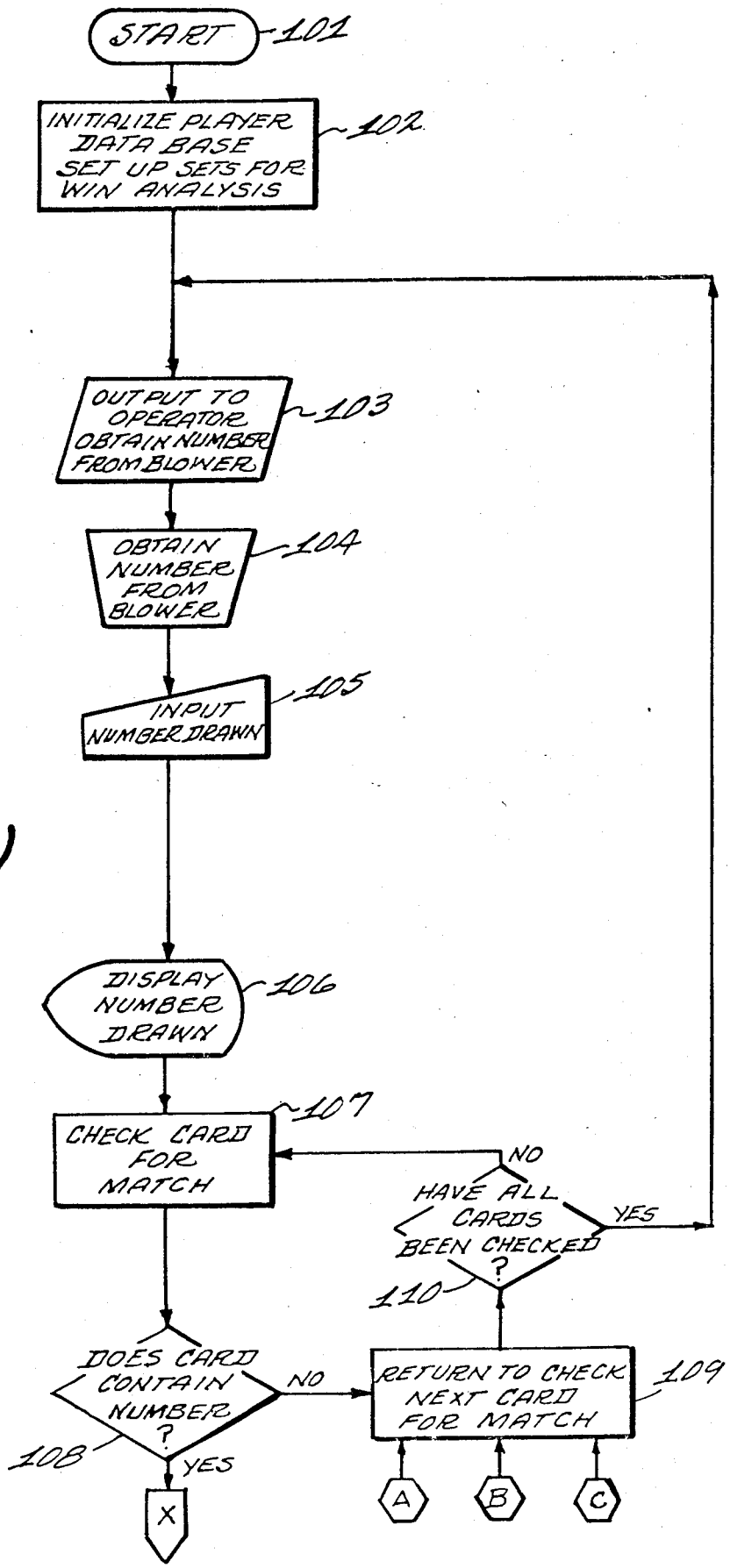
Figure 3B:
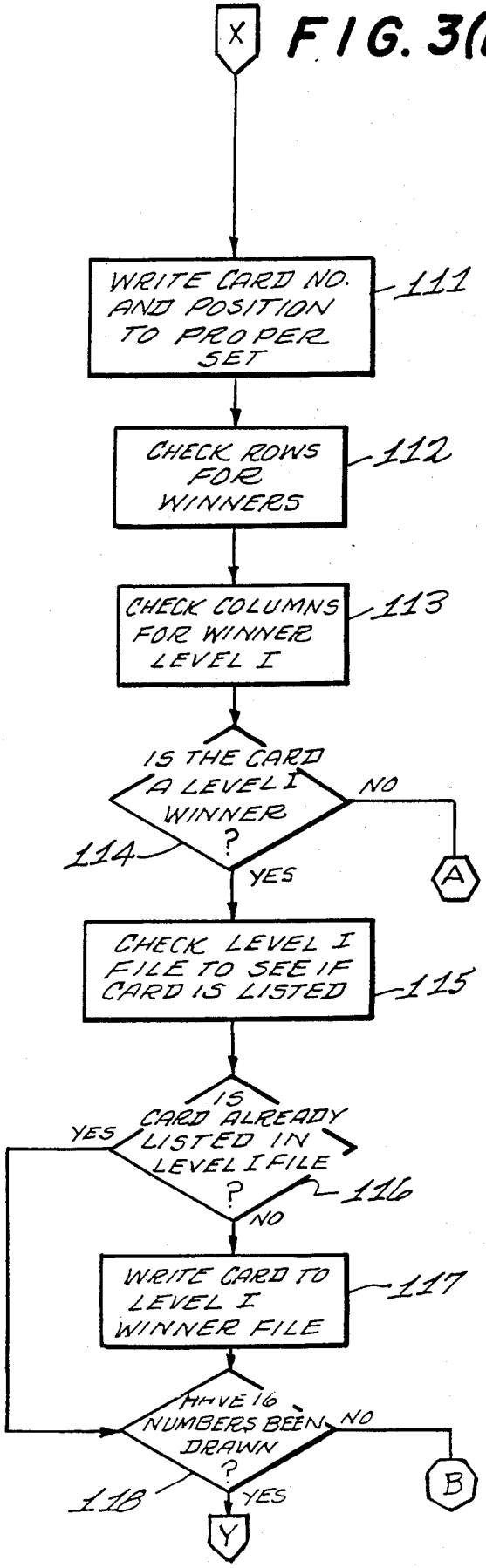

If, however, the answer to step 108 is YES, i.e., the card being checked does contain the number drawn, then the program proceeds to a step 111 which is shown on FIG. 3*b*. In step 111 the program instructs the computer to write the card number and position of the number on the card to the proper sets, and then the program proceeds to a step 112 where the program checks rows of the bingo card being checked for a winning card. In a subsequent step 113 the columns of the bingo card are checked to determine if the card is a winning card or a level 1 winner. In the step 114 the computer program actually determines whether the card is a level 1 winner, i.e., whether the card has completely been filled in at one of its rows or columns or at its four corners. If the answer to step 114 is NO then the program returns to check the next card in step 109, and the program then proceeds as has already been described above. If, however, the card is determined to be a level 1 winner at step 114, then the program proceeds from the YES output to a step 115 where a level 1 file is checked to determine if the card has already been listed as a winner. In step 116 the program actually determines if the card is already listed in the level 1 file. If the answer to step 116 is NO then the card is written to the level 1 winner file in step 117 and the program then proceeds to step 118. If, however, the answer to step 116 is YES, i.e., the card has already been declared to be a winner then the step 117 is bypassed and the computer proceeds directly to step 118 where it is determined if 16 numbers have been drawn. If the answer to step 118 is NO then the program is returned to step 109 and the program proceeds as has already been described above.

Figure 3D:
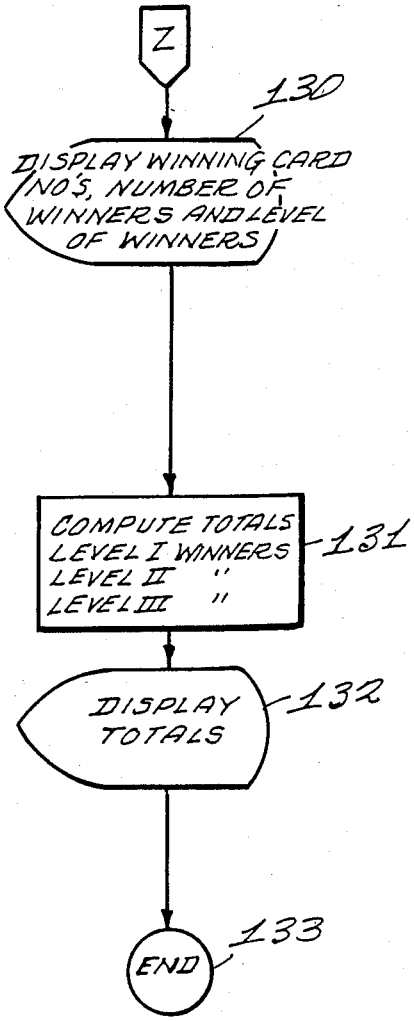
Figure 3C:
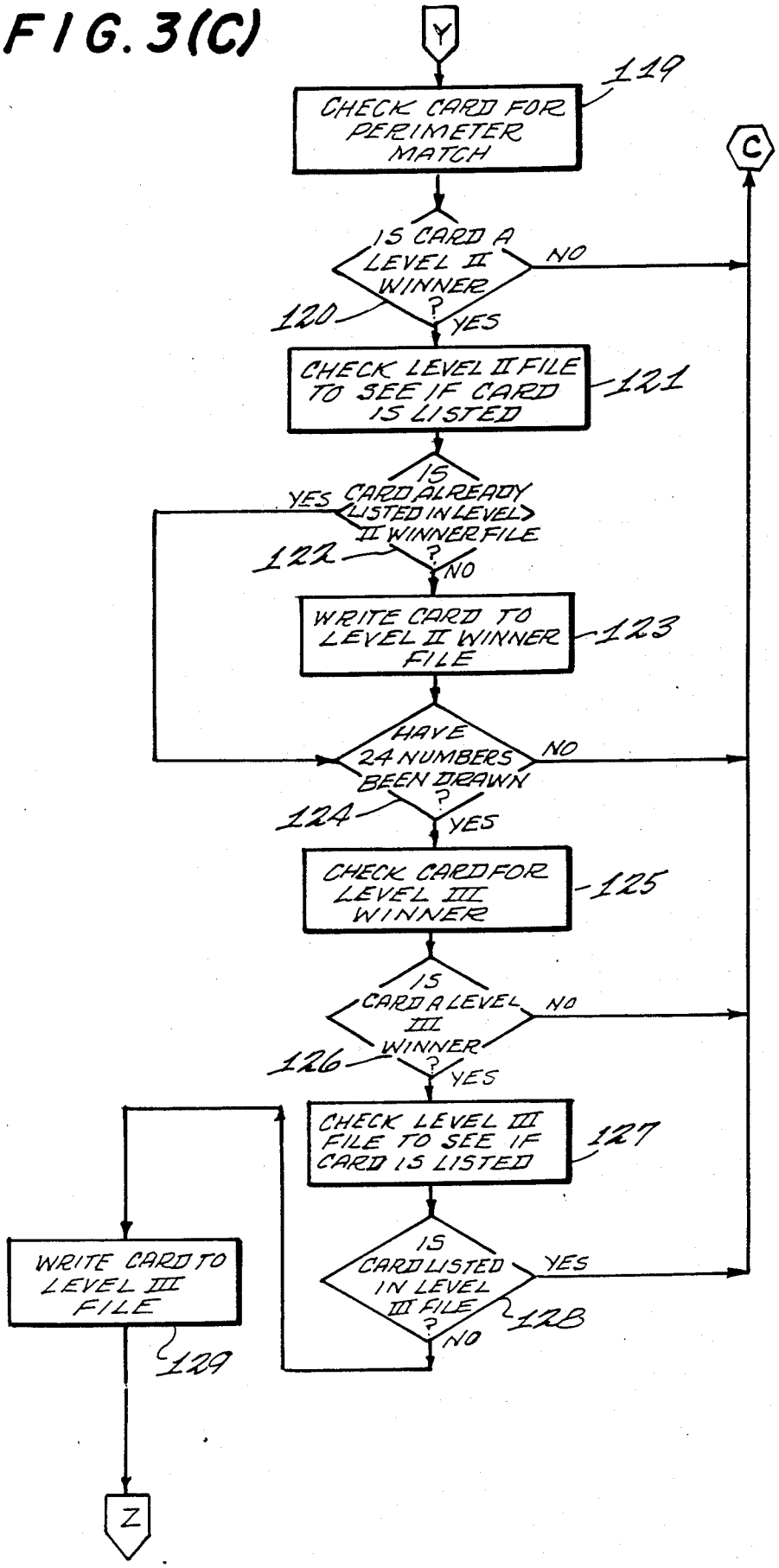

The reason for the step 118 is to determine whether there are any potential level 2 winners which the computer should check for, a level 2 winner being a bingo card which has its outer peripheral rows and columns completely filled. Therefore, in order to be a level 2 winner at least 16 numbers must have been drawn and there would be no reason for the computer to check for a level 2 winner if less than 16 numbers have been drawn, thus this is the reason for returning the program to step 109 if 16 numbers have not been drawn. If 16 numbers have been drawn then the program proceeds to a step 119, shown on FIG. 3*c*, where the card is checked for a perimeter match or level 2 winner. The program actually determines whether the card is a level 2 winner in decision step 120. If the card is not a level 2 winner then the program proceeds through the NO path back to step 109, where the program proceeds in the manner which has already been described above. If, however, the answer in step 120 is YES then the program proceeds to a step 121 where the level 2 file is checked to see if the card is listed.

In step 122 the program actually determines whether the card is already listed in the level 2 file and if the answer is NO the program proceeds to a step 123 where the card is written to the level 2 winner file and then the program proceeds to step 124. If, however, the answer to step 122 is YES then the step 123 is bypassed and the program proceeds directly to step 124, where the program determines if 24 numbers have been drawn. If the answer to step 124 is NO then the program proceeds to the step 109, where it proceeds in the manner which has been described above. If, however, the answer to step 124 is YES then the program proceeds to a step 125 where the card is checked for a level 3 winner. A level 3 winner being defined as a card in which every number in every row and column has been drawn. Therefore, as a result of the above described operation the computer will only check for a level 3 winner if 24 numbers have been drawn which is the minimum numbers which must be drawn in order for a level 3 winner to be possible. After the step 125 the program proceeds to step 126 where the program actually determines if the card is a level 3 winner. If the answer to step 126 is NO then the program returns to step 109, and subsequently proceeds in the manner which has been described above. If, however, the answer to step 126 is YES then the program proceeds to a step 127 where the level 3 file is checked to determine if the card has already been listed. After the step 127, the program proceeds to step 128 where the program actually determines if the card is listed in the level 3 file. If the answer to step 128 is YES then the program returns to step 109, and proceeds in the manner which has already been described above. If, however, the answer to step 128 is NO then the program proceeds to a step 129 where the card is written into the level 3 winner file. At this time, the program proceeds to a step 130, which is shown on FIG. 3*d*, in which the winning card numbers, the number of winners and the level of winners is displayed. The program then proceeds to a step 131 where the totals and numbers of levels 1, 2 and 3 winners are calculated and then the aforementioned totals are displayed in step 132, from which the program proceeds to an end step 133.

Figure 4A:
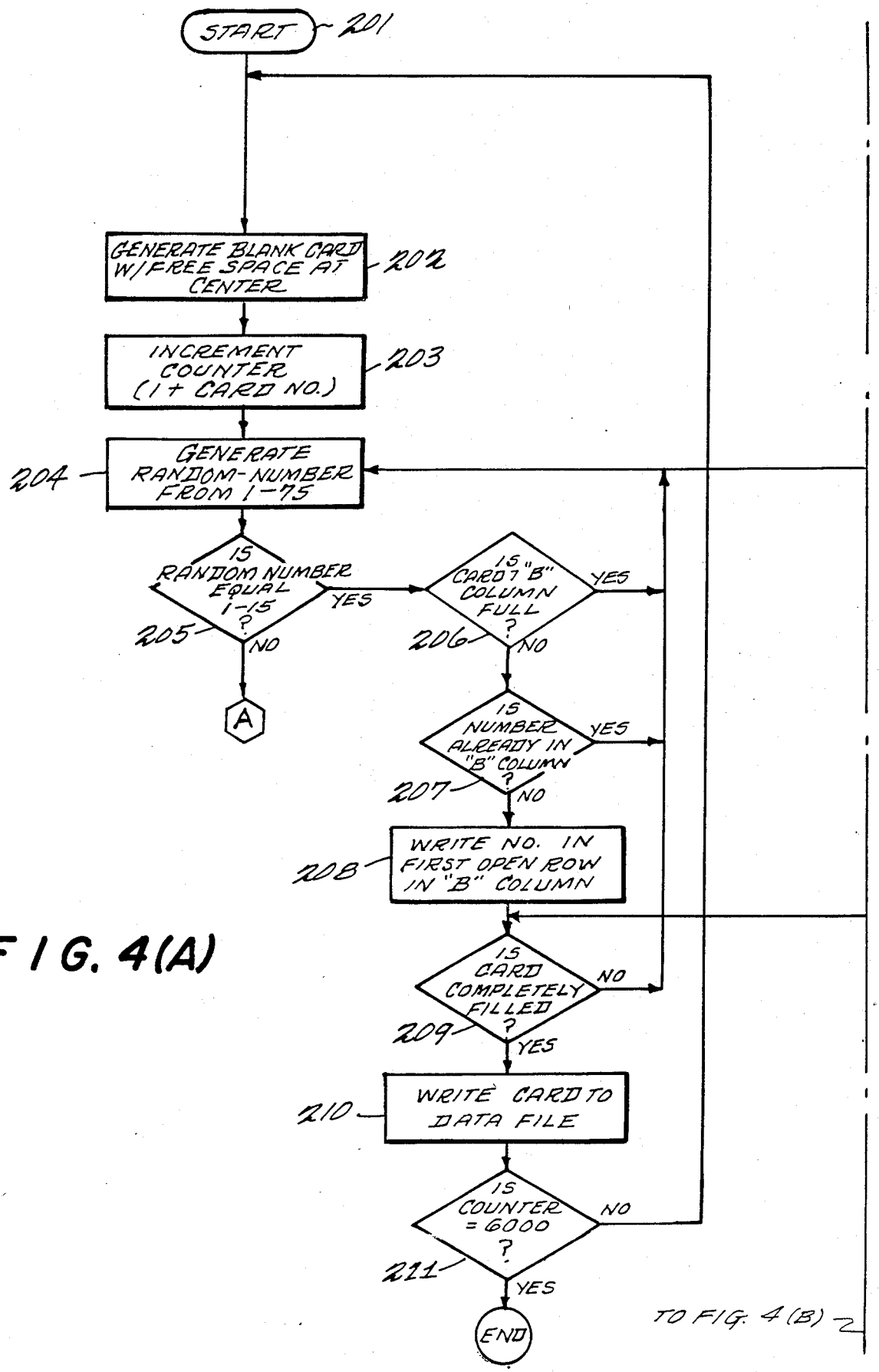
Figure 4B:
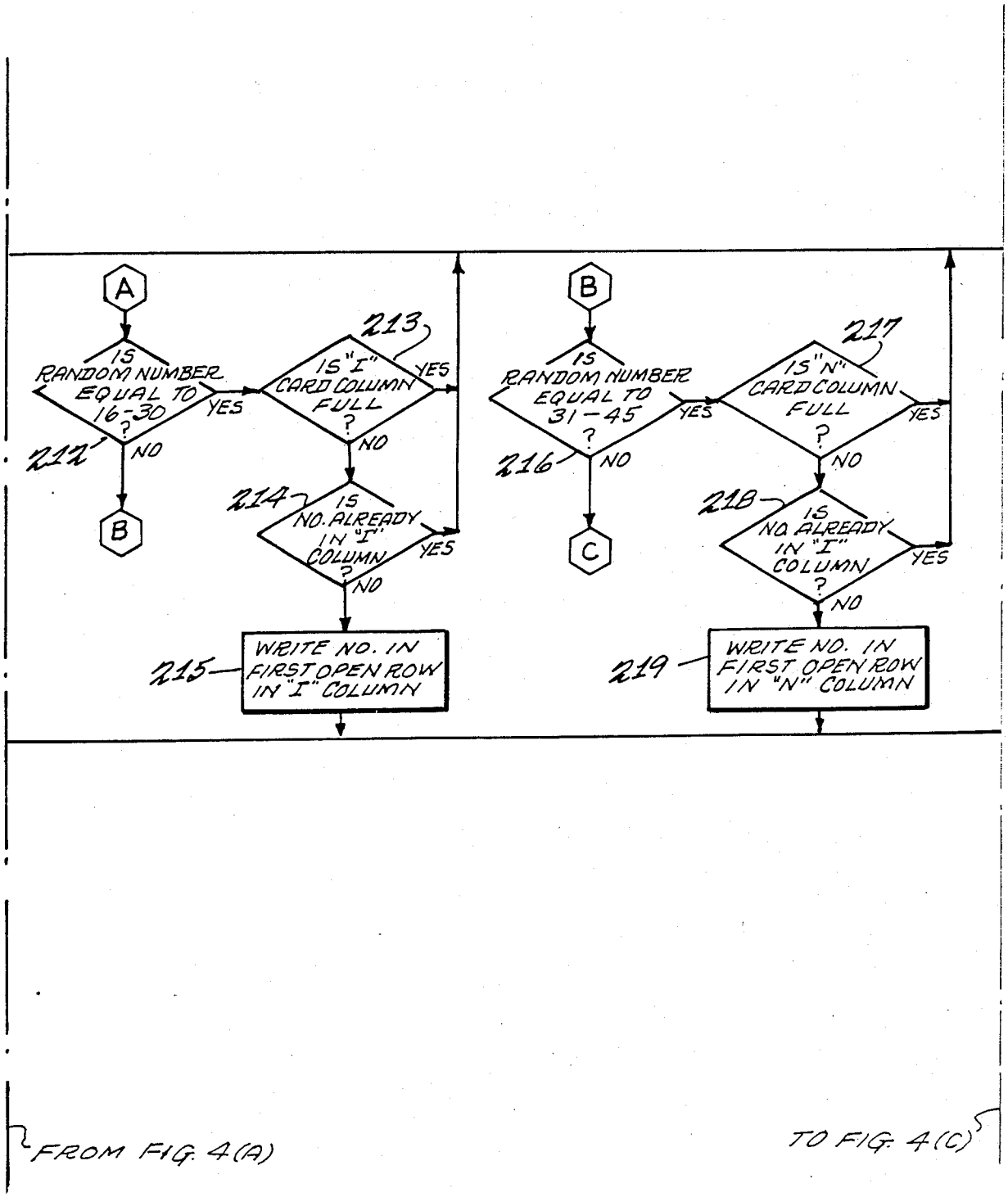
Figure 4C:
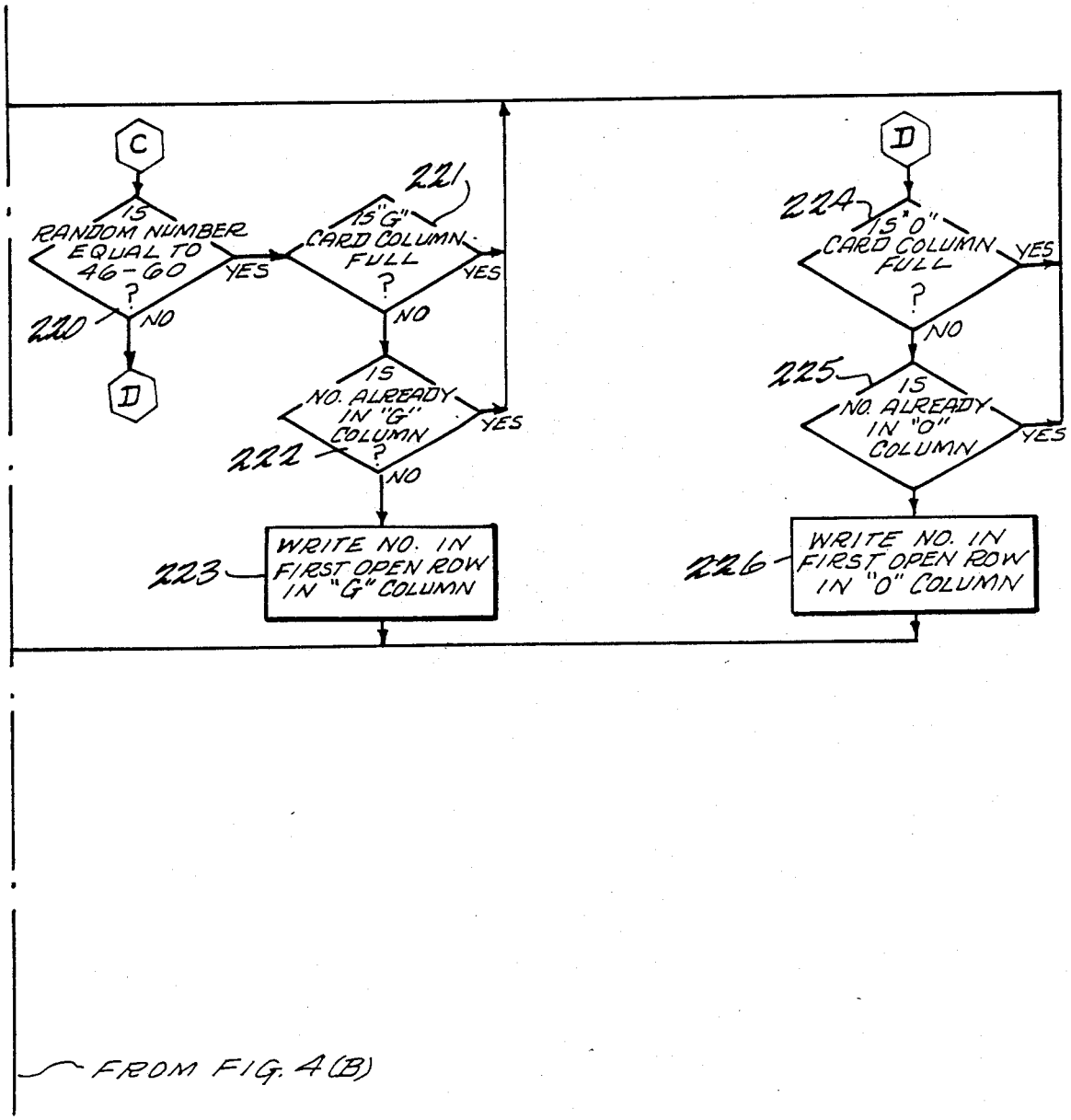

The computer is also capable of being programmed to generate the bingo game playing cards which are to be distributed to the geographically dispersed players. A flow chart describing a program for generating the bingo cards is shown in FIGS. 4*a*, 4*b* and 4*c*. In FIG. 4*a* after a start step 201 the program proceeds to a step 202 where the computer is instructed to generate a blank card having a free space at its center. The program then proceeds to a step 203 where a counter is incremented by 1 so that the program can keep track of the number of cards generated. The program then proceeds to a step 204 where the computer is instructed to generate a random number from 1–75 inclusive. In a decision step 205 the program determines whether the random number is in the range of 1–15 inclusive. If the answer to the decision step 205 is YES then the program proceeds to a decision step 206 where the program determines whether the B column of the card is already filled with numbers. If the answer to the decision step 206 is YES then the program returns to the step 204 for generating another random number. If, however, the answer to decision step 206 is NO then the program proceeds to a decision step 207 where the program determines whether the number is already in the B column. If the answer to the decision step 207 is YES then the program returns to the step 204, and operates as described above. If, however, the answer to the decision step 207 is NO then the program proceeds to a step 208 in which the computer is instructed to write the random number into the first open row in the B column of the card. At this time, the program proceeds to a decision step 209 where it is determined whether the card is completely filled. If the answer to the decision step 209 is YES then the program proceeds to a step 210 where the card is written to a data file, and then the program proceeds to a decision step 211 where it is determined if the counter is equal to 6,000. If the answer to the decision step 211 is YES then the program is ended, as the computer has generated 6,000 complete bingo cards. If, however, the counter is not at 6,000 then the program returns from the NO path of step 211 to step 202, where a subsequent blank card with a free space is generated and the program proceeds as described above.

Returning to the step 209, for the moment, if the answer to step 209 is NO, i.e., the card is not completely filled, then the program proceeds to the step 204 to generate an additional random number in order to progress towards the filling of the bingo card.

Returning to the decision step 205, if it is determined that the random number is not in the range of 1–15 inclusive then the program proceeds from the NO path of decision step 205 to a decision step 212, which is shown in FIG. 4*b*. The decision step 212 determines whether the random number generated is equal to 16–30 inclusive. If the answer to the decision step 212 is YES then, similarly to the aforementioned decision step 206, it is then determined in decision step 213 whether the particular column in which the range of numbers 16–30 is contained, i.e., the I column, is full. If the I column is determined to be full, then the program is returned to the step 204 for generating an additional random number, and if the I column is determined not to be full and the random number is determined not to already be in the I column, in step 214, then the number is written in the first open row in the I column in step 215.

If, however, the number is already in the I column, as determined in step 214, then similarly to the step 207 the program is returned to the step 204 for generating an additional random number. Subsequent to the step 215 the program returns to the step 209 to determine whether the card is completely filled, and if it is not completely filled the program is returned to the step 204 for generating an additional random number to continue the process of filling the bingo card. If, however, the step 209 determines that the card is completely filled then the card is written to the data file in step 210 and the program proceeds to step 211 for determining whether all of the 6,000 cards have been generated, as has been described above.

Returning to the step 212, if it is determined that the random number is not within the range of 16–30 inclusive then the program proceeds to a step 216 where it is determined whether the number is within the range of 31–45 inclusive. If the number is determined to be within the range of 31–45 inclusive, then similar steps are carried out with regard to determining whether the N column is full, whether the number is already in the N column and whether the number is to be written in the first open row in the N column, similarly as has been described above with regard to the B and I columns. If, however, the decision in step 216 is NO, i.e., the number is outside the range of 31–45 inclusive then the program proceeds to a step 220 where it is determined whether the random number is in the range of 46–60 inclusive. If the number is within the range of 46–60 then similar steps are carried out with regard to the G column, as has already been described with regard to the B and I columns. If, however, the random number is not in the range of 46–60 inclusive then the program immediately proceeds to a step 224 where it is determined whether the O card column is full. It should be noted that the program can immediately proceed to the step 224 without going through a decision step to determine whether the number is between 61–75, inclusive, because the program has already determined that the number is not within the range of 1–60 inclusive by proceeding through decision steps 205, 212, 216 and 220, and therefore the number must lie within the range of 61–75 inclusive, which are numbers found in the O column of a bingo card. Accordingly, the program then proceeds to determine whether the O card column is full, etc., as has been already described above with regard to the B and I columns.

Thus, it should be appreciated by those skilled in the art that the present invention is capable of generating the bingo cards which are to be used in association with the system that has been described above. Furthermore, it should also be appreciated by those skilled in the art that in addition to counting the number of bingo cards generated the program could also provide each bingo card generated with a unique alpha-numeric format number which could be used to identify the card as a winning card to the geographically dispersed audience, via the broadcasting television system means described above. Furthermore, each specific lot of cards can also receive an alpha-numeric serial number which would aid in identifying or determining whether a card purporting to be a winning card has been tampered with. In FIG. 6, there is shown one example of a bingo card which could be generated by the present invention. In the upper right hand corner of the bingo card, shown in FIG. 6, is the aforementioned alpha-numeric serial number (i.e., SN: AJ527) and in the center "Free Space" is the aforementioned unique alpha-numeric format number (i.e., FN:XZ715).

Figure 5A:
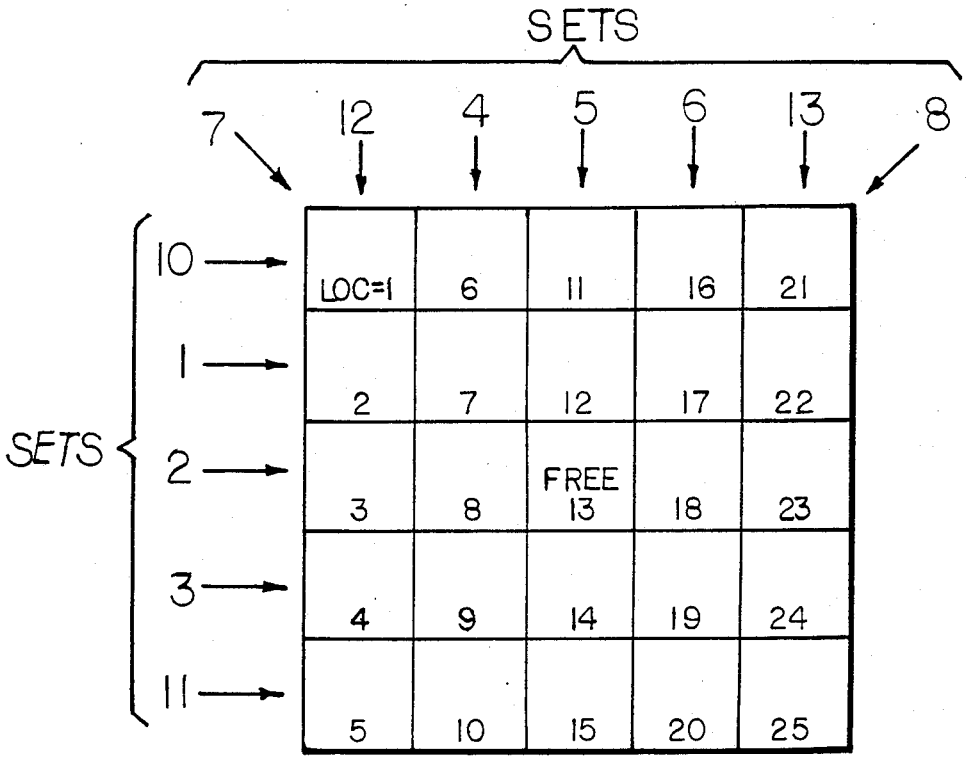
Figure 5B:
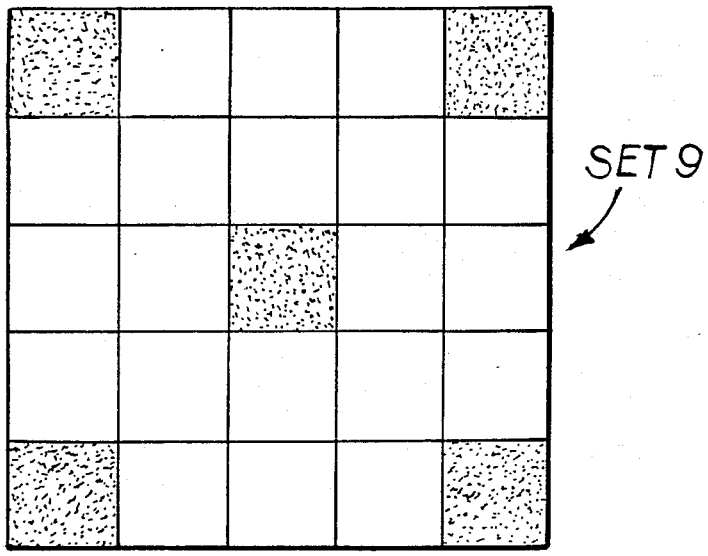

As has been mentioned above, the computer 3 of the present invention has been designed to "play" the bingo cards which have been set into its data base. FIGS. 5*a* and 5*b* will now be used to explain a method by which the computer is easily able to "play" the bingo cards. In FIG. 5*a*, a bingo card is graphically illustrated having locations 1 through 25, location 13 being the free space at the center of the bingo card. Thus, set 1 is defined by locations 2, 7 12, 17 and 22 on the bingo card, and set 7 is defined by locations 1, 7, 13 or the free space, 19 and 25 on the bingo card. The set 9 is shown in FIG. 5*b* to be comprised of the four corners and the center or free space, representing locations 1, 21, 5, 25 and 13. In determining whether a particular bingo card is a winner, the computer maintains the sets 1–13 for each of the bingo cards which have been entered into its data base. Thus, each bingo card is identified by a serial number and its sets and the sets are initially set to zero. The computer automatically increments by "1" those sets, of each bingo card, in which a drawn number appears. Thus, sets 2, 5, 7, 8 and 9 are automatically incremented because of the location 13 or free space.

If on a particular bingo card during the course of a game the numbers contained at locations 3, 8, 18 and 23 are drawn, the computer would increment sets 2 and 12 for the location 3, sets 2 and 4 for the location 8, sets 2 and 6 for the location 18 and sets 2 and 13 for the location 3. Whenever 5 increments have been made in any one set of a particular bingo card that particular bingo card is determined to be a level 1 winner. Therefore, in the above example the bingo card is a level 1 winner because set 2 has been incremented 5 times (for locations 3, 8, 18, 23 and 13 or the free space). A level 2 winner is determined when all of sets 10–13 have been incremented 5 times. A level 3 winner is determined when sets 1–3, 10 and 11 have been incremented 5 times.

As a result of the above described method the computer is able to work with sets rather than with cards. There are 13 sets because there are 13 different ways to win on a card, for example, 5 horizontal ways, 5 vertical ways, 2 diagonal ways and the four corners. Thus, for each card, the computer stores the number of entries in each of the 13 sets.

More specifically, when a number is card and if it is not present then the next card is scanned. Otherwise, the position containing the number drawn identifies which sets should be incremented.

Accordingly, the applicants have by virtue of the present invention overcome all of the drawbacks associated with the conventional game of bingo. As can be appreciated by those skilled in the art applicants' invention lends itself to bingo cards, distributed by commercial organizations, having specific format numbers identifying the 24 number combinations on each bingo card (plus the free space). Thus, the makeup of the bingo cards will be similar to those now presently provided by conventional printing processes for the conventional playing of the game, but will be further identified by a unique or specific format number at the center "Free Space" location of the card.

Numbers will be called at random as in the conventional bingo game and will utilize a conventional blower device or bingo ball popper with 75 sequentially numbered ping-pong balls available for selection. Called numbers will be entered into the system until one or more of the level 1 winners occurs. The bingo card numbers, i.e., the serial number of the winning bingo card, will be displayed on a winner board, as will each individual number as it is called. In addition, throughout the bingo game the previously called numbers will appear on a 75 position number board for the convenience and ease of the bingo game players.

The game as described above is capable of continuing into a level 2 winning series and then to a level 3 winning series. As each winner occurs, the winning bingo card format number will be displayed instantaneously to the geographically dispersed group of players. Furthermore, players will be able to mark their cards as the game progresses, and the format number on the winning card will correspond to the winning format number displayed by the computer. In this way, the aforementioned group of players which have heretofore played at a competitive disadvantage will be able to assure themselves of their winnings even if they are unable to mark their card as play progresses.

Although the invention has been described with respect to a specific embodiment, it should be obvious that there are numerous variations within the scope of the present invention. For example, the computer can also be used to randomly generate the bingo card numbers thereby taking the place of the conventional bingo ball popper. In addition, although the specific embodiment was described with respect to a bingo game, the scope of the present invention is not limited thereto but is equally applicable to other card games as well. Thus, the present application is intended to cover not only the described embodiment, but also those variations falling within the scope of the appended claims.

What is claimed is:

1. An automated card game system played simultaneously by plural human participants and by a data processing apparatus which automatically identifies and annunciates winning participants, said system comprising:

a plurality of individually identifiable game cards, each having respectively corresponding game data contents;

data processing means having a digital memory means for storing said game data;

play means for randomly generating sequential play data which may match a portion of the game data contents of a portion of said game cards;

means for communicating said sequential play data to said human participants whereby they are enabled to play their respective game cards and for communicating said sequential play data to said data processing means; and said data processing means for automatically: (1) selecting at least one winning sequence of play data, (2) matching said sequential play data to said stored game data, (3) identifying and communicating winning game cards to said participants at the time said selected at least one winning sequence of play data has been generated (4) changing the game and selecting an associated winning sequence and (5) identifying and communicating winning game cards to said participants at the time said associated winning sequence of play data corresponding to said changed game has been generated.

2. A system as claimed in claim 1, wherein said play means is a portion of said data processing means.

3. A system as claimed in claim 1, wherein said means for enunciating outputs a RGB color signal suitable for inputing to an NTSC signal converter for broadcasting said sequential play data.

4. A system as claimed in claim 1, further comprising an NTSC signal converter and wherein said means for communicating outputs a RGB color signal to said NTSC signal converter for broadcasting said sequential play data.

5. A system as claimed in claim 2, further comprising an NTSC signal converter and wherein said means for communicating outputs a RGB color signal to said NTSC signal converter for broadcasting said sequential play data.

6. An automated bingo game comprising: means for randomly generating a plurality of bingo cards each card having respectively corresponding game date contents for distribution to a plurality of players;

said generating means also continually monitors the played status of said bingo cards and determines when one of said bingo cards has won at which time said generating means changes the bingo game to a new version and continues monitoring the played status of said bingo cards in order to determine and display when one of said bingo cards has won said new version of the bingo game;

memory means for storing said plurality of bingo card game data contents corresponding to said plurality of bingo cards;

means for randomly and sequentially determining bingo card play data;

registering means for sequentially entering into said memory said sequentially determined bingo card play data;

signal generating means for generating signals representative of each of said sequentially determined bingo card play data;

display means for receiving said signals from said generating means and sequentially displaying said bingo card play data wherein said players may mark their respective bingo cards in accordance with said displayed bingo card play data and wherein said memory means records in association with said plurality of bingo card game data contents, said determined bingo card play data entered by said registering means so as to simultaneously also play by the players.

7. An automated bingo game as claimed in claim 6, further comprising a NTSC signal converter for receiving said signals from said generating means and for broadcasting said bingo card play data.

8. An automated bingo game as claimed in claim 6, wherein each one of said plurality of bingo cards has a plurality of sets which define combinations of locations on the bingo cards needed to win the bingo game, each set having a value, for each one of said plurality of bingo cards said generating means increments the value of each one of said plurality of sets which contains one of said sequentially determined bingo card numbers, until the value of at least one of said plurality of sets reaches a predetermined number in order to determine when one of said plurality of bingo cards has won.

9. An automated bingo game comprising:

a plurality of bingo cards to be distributed to players each one of said plurality of bingo cards having a plurality of sets which define combinations of locations on the bingo cards needed to win the bingo game, each set having a value;

first means having a memory for storing digital data representations of said plurality of bingo cards;

second means for sequentially determining bingo card playing data;

a keyboard interconnected with said first means for entering said bingo card playing data into the memory of said first means, said first means generating output signals in accordance with said bingo card data entered by said keyboard; and a display means for receiving said output signals from said first means and displaying said bingo card playing data;

said first means incrementing the value of each one of said plurality of sets, for each one of said plurality of bingo cards, which contains one of said sequentially determined bingo card playing data, until the value of at least one of said plurality of sets reaches a predetermined number in order to determine when one of said plurality of bingo cards has won.

10. An automated bingo game as claimed in claim 9 wherein said first means randomly generates said plurality of bingo cards.

11. An automated bingo game as claimed in claim 9, wherein said first means continually monitors the played status of said bingo cards and determines and displays when one of said bingo cards has won at which time said memory means changes the bingo game to a new version and continues monitoring the played status of said bingo cards in order to determine and display when one of said bingo cards has won said new version of the bingo game by determining when more than one of said plurality of sets has reached said predetermined number.

12. An automated bingo came as claimed in claim 9, wherein said output signal is an RGB color signal suitable for inputing to a NTSC signal converter for broadcasting over a particular T.V. channel or cable T.V. system.

13. An automated bingo game system, played simultaneously by plural human participants and by a data processing apparatus, capable of progressively playing at least two winning versions of bingo, said system comprising:

a plurality of individually identifiable bingo game cards, each having respectively corresponding bingo game data contents, each one of said bingo game cards having a plurality of sets which define combinations of locations on the bingo game cards needed to win a bingo game, each set having a value;

data processing means having a digital memory means for storing said bingo game data;

play means for randomly generating sequential play data which may match a portion of the bingo game data contents of a portion of said bingo game cards;

means for communicating said sequential play data to said human participants whereby they are enabled to play their respective bingo game cards and for communicating said sequential play data to said data processing means; and said data processing means for automatically: (1) selecting winning sequences of play data corresponding to each of said at least two winning versions of bingo, (2) matching said sequential play data to said stored bingo game data, (3) identifying and communicating winning bingo game cards to said participants at the time a first of said winning sequences of play data are generated and (4) progressively changing the winning version of the bingo game;

said data processing means incrementing the value of each one of said plurality of sets, for each one of said plurality of bingo cards, which contains one of said sequential play data, until the value of at least one of said plurality of sets reaches a predetermined number in order to determine when one of said game cards has won, and until more than one of said plurality of sets reaches said predetermined number in order to determine when one of said bingo game cards has won said changed version of the bingo game.

14. A method for playing a bingo game simultaneously by human participants and by a data processing apparatus, said method comprising the following steps:

storing bingo game data contents for each one of a plurality of bingo game cards in said data processing apparatus, each one of said bingo game cards having a plurality of sets which define combinations of locations on the bingo game cards needed to win a bingo game, each set having a value;

distributing said bingo game cards to said human participants;

generating sequential play data which may match a portion of the bingo game data contents of a portion of said bingo game cards;

communicating said sequential play data to said human participants, whereby they are enabled to play their respective bingo game cards, and to said data processing means; and automatically selecting with said data processing means a winning sequence of play data;

incrementing with said data processing means each one of said plurality of sets, for each one of bingo game cards, which contains one of said sequential play data;

identifying with said data processing means a winning bingo game card by determining when one of said plurality of sets for a specific bingo game card has been incremented to a predetermined number and communicating said winning bingo game card to said participants at the time said selected winning sequence of play data has been generated;

automatically changing with said data processing means the winning version of the bingo game and selecting an associated winning sequence of play data; and identifying with said data processing means a winning changed bingo game card by determining when more than one of said plurality of sets for a specific bingo game card have been incremented to said predetermined number and communicating said winning changed bingo game card to said participants at the time said associated winning sequence of play data, corresponding to said changed winning version of the bingo game, has been generated.

15. A method as claimed in claim 14, wherein said communicating step comprises inputing a RGB color signal, representing said sequential play data, to an NTSC signal converter for broadcasting.

16. An automated card game system played simultaneously by plural human participants and by a data processing apparatus which automatically identified and annunciates winning participants, said system comprising:

a plurality of individually identifiable game cards, each having respectively corresponding game data contents, each one of said game cards having a plurality of sets which define combinations of locations on the game cards needed to win a game, each set having a value;

data processing means having a digital memory means for storing said game data;

play means for randomly generating sequential play data which may match a portion of the game data contents of a portion of said game cards;

means for communicating said sequential play data to said human participants whereby they are enabled to play their respective game cards and for communicating said sequential play data to said data processing means; and said data processing means for automatically: (1) selecting at least one winning sequence of play data, (2) matching said sequential play data to said stored game data, (3) identifying and communicating winning game cards to said participants at the time said selected at least one winning sequence of play data has been generated (4) changing the game and selecting an associated winning sequence and (5) identifying and communicating winning game cards to said participants at the time said associated winning sequence of play data corresponding to said changed game has been generated;

said data processing means incrementing the value of each one of said plurality of sets, for each one of said game cards, which contains one of said sequential play data, until the value of at least one of said plurality of sets reaches a predetermined number in order to determine when one of said game cards has won, and until more than one of said plurality of sets reaches said predetermined number in order to determine when one of said game cards has won said changed game.

17. A system as claimed in claim 16, wherein said play means is a portion of said data processing means.

18. A system as claimed in claim 17, further comprising an NTSC signal converter and wherein said means for communicating outputs a RGB color signal to said NTSC signal converter for broadcasting said sequential play data.

19. A system as claimed in claim 16, wherein said means for enunciating outputs a RGB color signal suitable for inputting to an NTSC signal converter for broadcasting said sequential play data.

20. A system as claimed in claim 16, further comprising an NTSC signal converter and wherein said means for communicating outputs a RGB color signal to said NTSC signal converter for broadcasting said sequential play data.

* * * * *